US006397621B1

(12) United States Patent
Reynaud et al.

(10) Patent No.: US 6,397,621 B1
(45) Date of Patent: Jun. 4, 2002

(54) HEATING PUMPING INSTALLATION, IN PARTICULAR WITH A REFRIGERATION FUNCTION

(75) Inventors: Jean-François Reynaud, Jouy le Moutier; Guy Chambaron, Conflans Sainte Honorine; Henri Rodie-Talbere, Ville D'Avray, all of (FR)

(73) Assignee: Electricite de France Service National (FR)

( * ) Notice: Subject to any disclaimer, the term of this patent is extended or adjusted under 35 U.S.C. 154(b) by 5 days.

(21) Appl. No.: 09/691,870

(22) Filed: Oct. 19, 2000

(30) Foreign Application Priority Data

Oct. 25, 1999 (FR) ..... 99 13272

(51) Int. Cl.[7] ..... F25B 13/00; F25B 27/00

(52) U.S. Cl. ..... 62/324.1; 62/510; 62/238.4

(58) Field of Search ..... 62/324.1, 510, 62/498, 115, 467, 238.1, 238.4, 238.5; 165/62; 417/331, 332, 334

(56) References Cited

U.S. PATENT DOCUMENTS 4,149,585 A * 4/1979 Sterlini ..... 62/510 X
4,282,070 A 8/1981 Egosi
4,323,109 A * 4/1982 Jaster ..... 62/510 X
4,420,373 A 12/1983 Egosi
4,437,316 A 3/1984 Dyer et al.
4,454,720 A 6/1984 Leibowittz
4,522,035 A 6/1985 Dyer et al.
4,638,642 A 1/1987 Tokumo
4,896,515 A 1/1990 Endou
5,388,397 A * 2/1995 Frutschi ..... 60/39.05

* cited by examiner

*Primary Examiner*—Chen-Wen Jiang
(74) *Attorney, Agent, or Firm*—Piper Rudnick

(57) ABSTRACT

The refrigeration cycle uses an evaporation zone prior to compression and a condensation zone after the latter, in which the thermodynamic fluid used in the cycle as well as the fluid used in the cold-exchange and heat-exchange cycles is water. The installation is operated on the basis of dynamic compression in two separate compression stages linked to one another by at least one zone with de-superheating and enclosed in a hermetically sealed and heat-insulated enclosure confining the vapor at very low pressure; the wheels of these two stages are mounted directly on the opposite ends of the shaft of a common, sealed, variable speed electric motor disposed inside the enclosure between these stages.

28 Claims, 9 Drawing Sheets

HEATING PUMPING INSTALLATION, IN PARTICULAR WITH A REFRIGERATION FUNCTION

FIELD OF THE INVENTION

The present invention relates to a heat pumping installation, in particular with a refrigerator function.

BACKGROUND OF THE INVENTION

Such installations are already used for the cold they produce and are applied for cooling purposes both in industrial processes (molding of plastics, manufacture of electronic components . . . ) and in the tertiary sector (distribution of foodstuffs, air-conditioning for computers . . . ) as well as for improving personal comfort (in cooling or air-conditioning systems in premises).

They have the advantage of avoiding the use of organic thermodynamic fluids in the compression-expansion cycle such as those belonging to the CFC family (chlorofluorocarbons), which have an adverse effect on global warming, or HCFCs (hydrochlorofluorocarbons) or HFCs (hydrofluorocarbons), which have a lesser but nonetheless not insignificant impact in terms of the greenhouse effect.

Their disadvantage, on the other hand, is the need to cope with very large volumes of vapor, particularly on a level with the compressor, which is one of the reasons why installations incorporating water vapor cycles have seen only very limited development to date.

Prototypes of such installations using water as the thermodynamic fluid and in cold-exchange and heat-exchange cycles have nevertheless already been built on an industrial scale. One of these, with a calorific output of some 2000 kW, used to cool extrusion machinery, uses an open production cycle to generate cold by evaporation, compression, condensation and discharge of water to the atmosphere, which constitutes a first disadvantage. It uses two independent steam compressors disposed face to face at the ends of a sealed, low-pressure enclosure, their suction inlets being arranged facing one another on either side of the evaporator, and these compressors, of the centrifuge type with flexible blades imparting to them a "variable geometry", being driven respectively by two electric motors, also of variable speed, outside the enclosure. Another disadvantage inherent in this type of installation resides in the fact that they require a large amount of space and carry a risk of air getting into the shaft ducts as well as heat losses as dissolved air gets into the installation via the open circuit of the condenser, which complicates the problem of degassing; on this issue, it should be pointed out that the non-condensable elements in this instance are drawn off at evaporation pressure, i.e. at low pressure. Furthermore, there is a susceptibility to relatively high "nips" (differences between the exchange temperatures) on a level with the evaporator and the condenser.

Another, more compact prototype with a refrigeration output in the order of 800 kW is operated globally using the same thermodynamic cycle with water and also uses two separate compressors disposed inside the hermetically sealed enclosure along with their respective motors; although this approach solves the problem of sealing at the shaft ducts, the high peripheral velocity of the compressor wheels required to compress very large volumes of vapor, has meant designing them so that they use a blade structure made from carbon fibers, which imparts to them the necessary strength to withstand centrifugal forces but at the expense of service life, these wheels being very sensitive to erosion due to the impact of water droplets, incurring a risk that they will be driven at high speed at the suction end of the compressors.

Accordingly, the objective of this invention is to retain the advantages inherent in using water as a thermodynamic fluid but avoid the disadvantages of the techniques of the prior art in a heat pumping installation built to an industrial scale, the primary aim specifically being to produce cold but without ruling out the production of heat.

To this end, an installation proposed by the invention, of the general type outlined above, is characterized in that the refrigerant cycle uses a process of dynamic compression with two separate compression stages, linked to one another by at least one heat exchange zone (de-superheated and/or economizer) and contained in a steam confinement enclosure which is hermetically sealed and heat-insulated, and in that the wheels of these two sections are mounted directly on the opposite ends of the shaft of a common, sealed electric variable speed motor disposed inside said enclosure, between these stages.

Opting for a fully "integrated" motor-compressor system of this type firstly makes for a more compact system and secondly overcomes the shaft sealing problem and, in a more economic manner, also resolves the tricky problem of designing a compressor capable of providing aerodynamic performance and advanced mechanical features whilst limiting the cost price of the installation. In particular, opting for a single electric motor to drive the two compression stages, each having one (in the case of compression by centrifuge, for example) or more (in the case of axial compression) compression wheel stages, and without the need to use speed multiplication stages, represents a decisive simplification in terms of structure. Furthermore, this design of confining the installation enables the compressor to be run without oil, thereby simplifying running and maintenance operations, whilst preventing fouling in the refrigerant fluid. It should be noted at this point that what are referred to as the "centrifuge" compression stages, which will be used by preference over axial compression stages, will comprise, in a conventional manner and for each of their constituent stages (of which there will be one or two in principle), a mobile wheel preceded by a suction convergent and followed by a static diffuser, either plain or provided with fins.

It should also be noted that the use of at least one vapor de-superheater between the two compression stages will prevent excessive temperatures from being reached, reduce the compression work of the second stage and help to improve the efficiency of the cycle, namely, will increase the ratio of refrigerant or calorific output to electrical energy needed to operate the installation, this efficiency possibly reaching a value of as much as 7 to 8, which is very satisfactory. This de-superheating after the first compression stage may be partially run by expansion-flash of the water coming from the condenser and returned to the evaporator, the expansion flash causing the water to be partially cooled without the need for any intermediate heat exchange surface, thereby constituting an economizer.

By preference, said electric motor will be a synchronous rotary motor with permanent magnets co-operating with a frequency controller, enabling the speed and hence the rotation speed of the compressor wheels to be varied to suit the vapor flows treated and enabling operation at partial load within the limits of the compressor's aerodynamic stability. Opting for a motor of this type will ensure that there is a minimum of heat loss on a level with the rotor, which is an important factor given the poor heat exchanges achieved in an enclosure in which, when producing cold, the prevailing vapor pressure is very low. However, it would be conceivable to use other types of less expensive motors, for example asynchronous motors, with a device for eliminating heat losses.

The bearings for the shaft of said electric motor may be of any type suitable for the function they perform, for example ceramic roller bearings, or alternatively of the fluid or plain type, operated by water and having an anti-cavitation device, or even by oil and having a sealing device, or may be of the magnetic type, in which case it will be impossible for the refrigerant fluid to be contaminated by lubricant.

As a result of one feature of the invention, the shaft bearings for said motor are disposed to the side of the latter, the compressor wheels being mounted in an overhanging arrangement on the ends of the said shaft although the reverse layout is also possible: compressor wheels disposed between the motor and the bearings with no overhanging mounting.

Another feature of the installation resides in the fact that the two compression stages are disposed opposing one another on either side of the common electric drive motor, with their respective inlets (intakes) directed towards the ends of the confinement enclosure (contrary to the prior art described earlier), evaporation and de-superheating zones being provided between the ends of the enclosure and the inlet of the first and the inlet of the second compression stage respectively.

This layout provides compensation for the axial reactions due to the wheels, helps in obtaining greater compactness, particularly in terms of length, and facilitates connection to the external water circuits.

In situations where it would be necessary to increase the compression rate, particularly under certain climatic conditions, (when the external temperature is too high or there is too great a variance between the evaporation/condensation temperature), the two compression stages could also be linked to a third compression stage disposed inside the confinement enclosure—or placed in communication therewith—and provided as a booster disposed upstream or downstream of the compressor or alternatively between its two stages.

Advantageously, this booster will be driven by a hydraulic turbine driven on water borrowed in particular from the internal circuit, on a level with the evaporation or condensation stages but it could also be driven by a steam expansion turbine or an independent electric motor, optionally at a different speed from that of the compressor, which might even be at a standstill if there is a return to normal climatic conditions.

Advantageously and still with a view to reducing the cost price and easing the rotation loads, said booster or the compression stages may be provided as one or more compression wheels having a rotor with a rotating flange provided with radial flat vanes and optionally co-operating with static blading to pre-rotate the fluid.

The general layout of the installation may differ slightly depending on whether it has a booster or not: it will then be characterized, respectively, in that the condensation zone is located at the end of the confinement enclosure on the side of the suction inlet of the second compression stage or in that this condensation zone is located between the zone with de-superheating and this suction inlet of the second compression stage.

BRIEF DESCRIPTION OF THE DRAWINGS

These features of the invention as well as additional aspects affecting the structure of the installation and its thermodynamic operation will be more readily understood from the following description of examples, given by way of illustration and not restrictive in any respect, with reference to the appended drawings, of which.

DETAILED DESCRIPTION OF THE INVENTION

Figure 1:
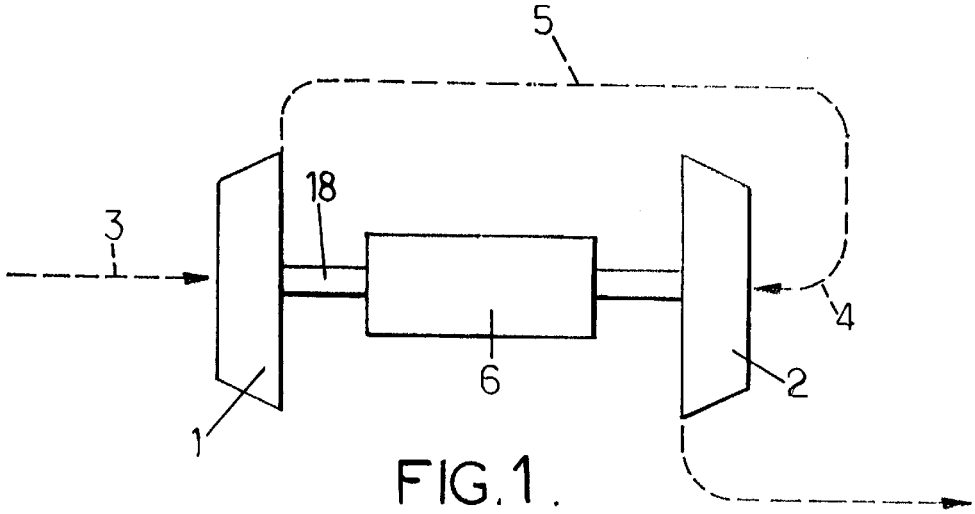
FIG. 1 is a schematic view showing one possible layout of the installation, assumed to have only two compression stages, FIG. 1' showing a variant with two compression stages in parallel.
Figure 1:
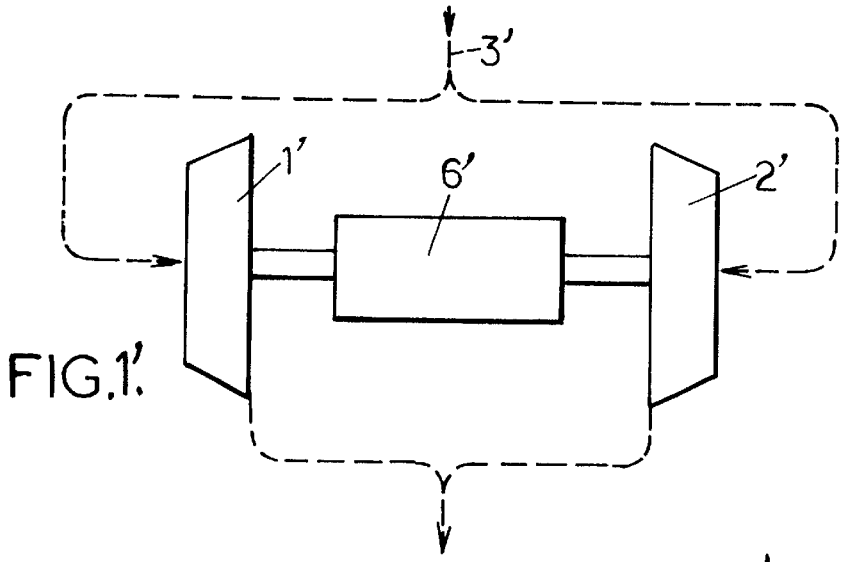

In FIG. 1, reference numbers 1 and 2 denote the two compression stages of the installation, the suction inlets 3 and 4 of which are disposed opposing one another, the outlet of stage 1 being linked by lines 5 to the inlet 4 of stage 2. The mobile wheels of the two stages are fixed onto the ends of the shaft 18 of a common variable speed electric motor 6.

FIG. 1' illustrates a variant in which two compression stages 1' and 2' are used, mounted in parallel, having a common inlet 3' and driven by a common motor 6', in order to produce higher refrigeration outputs. These stages may be followed by a compression stage, which may also comprise two stages in parallel and/or a booster.

Figure 2:
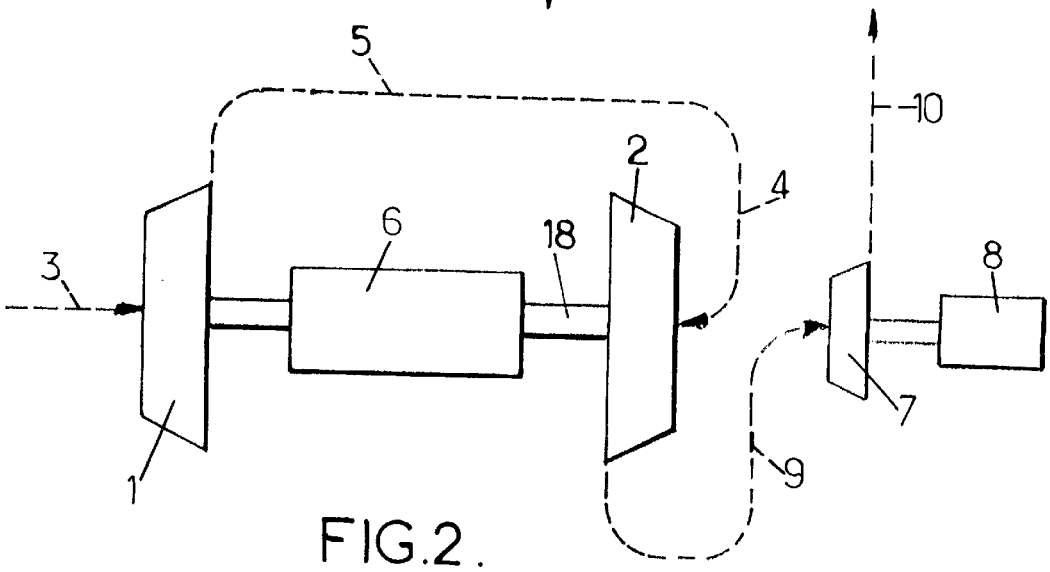
FIG. 2 is a schematic view showing a general layout of the installation where a third compression or booster stage is provided.
Figure 3:
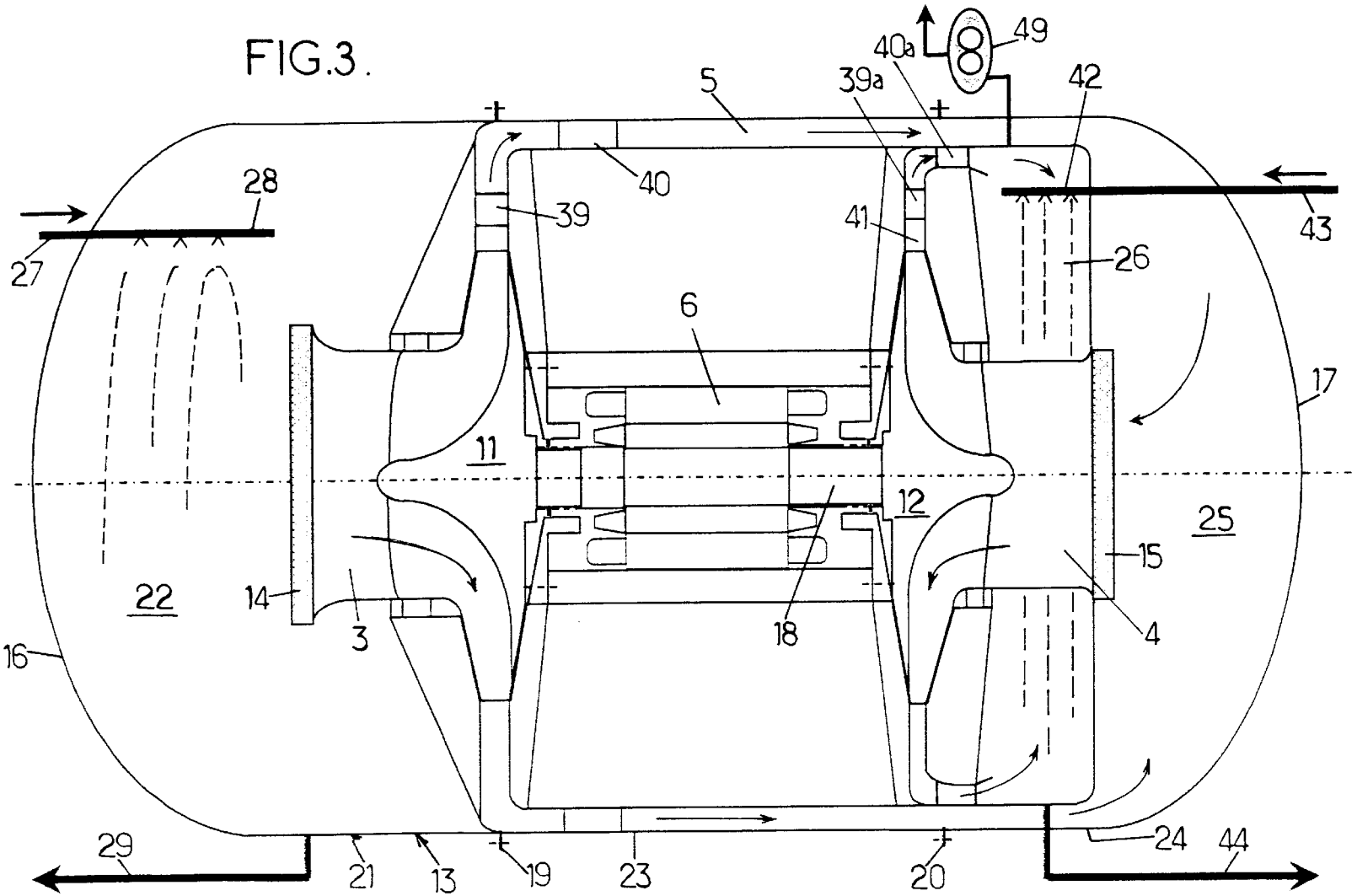
FIG. 3 is a more detailed view in axial section of an installation similar to that of FIG. 1.
Figure 13:
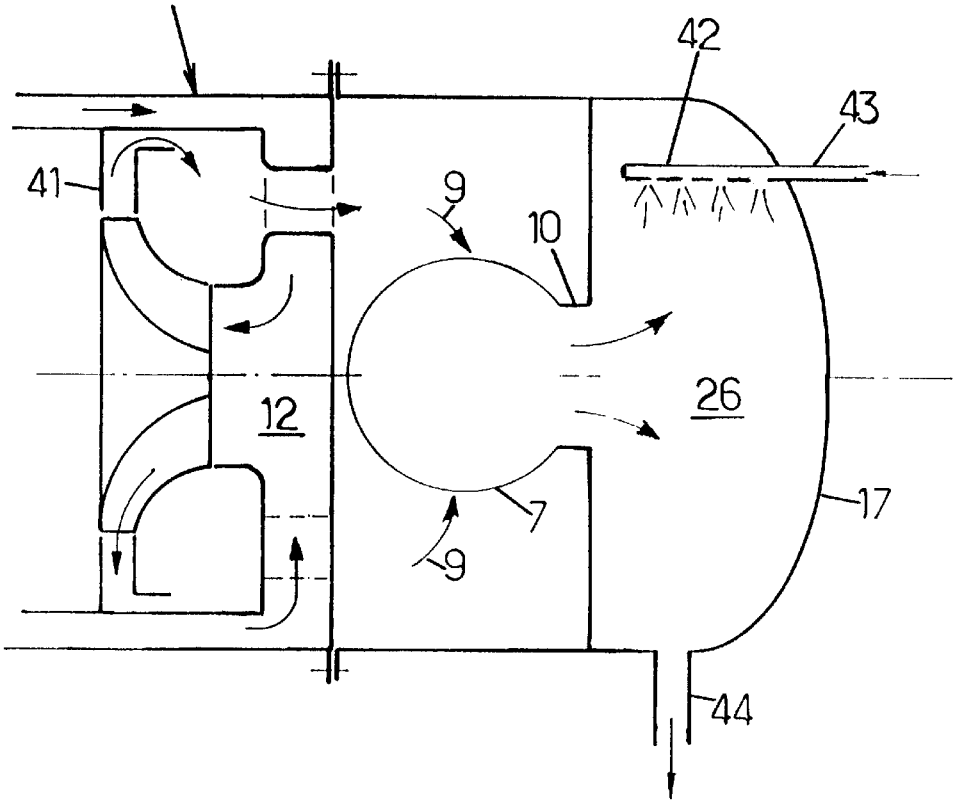
FIG. 13 is a partial schematic view of the installation, showing a booster incorporated downstream.

FIG. 2 illustrates an installation having a third compression stage (or booster) 7 driven by an independent motor 8, the suction inlet 9 of which communicates with the outlet of the second compression stage 2 whilst the delivery 10 communicates with a condensation zone; the way in which this booster is incorporated in the system is best illustrated in FIG. 13, the same reference numbers as those of FIG. 3 being used to denote common parts.

In FIG. 3, illustrating an installation without a booster, references 11 and 12 denote the centrifuge wheels for compressing water vapor (which are assumed to be semi-open in this drawing) belonging respectively to the two compression stages 1 and 2 mentioned above, each having one compression stage for example, together forming the compressor of the thermodynamic cycle, which is operated in a hermetically sealed confinement enclosure 13 placed at very low pressure, these two stages being arranged opposing one another as mentioned above: their suction inlets 3 and 4, each provided with a respective liquid/vapor separator or de-gassing system 14, 15, are directed towards the two opposite ends of the enclosure, shown by references 16 and 17 respectively. The moving wheels 11 and 12 of these two compression stages 1 and 2 are fixed in an overhanging arrangement on the opposite ends of the shaft 18 of the above-mentioned common electric motor 6, which is of a synchronous type and sealed, and whose rotor advantageously has permanent magnets. Sine the bearings of the shaft 18 are lubricated without oil, as will be described below, maintenance is facilitated and there is no risk of the refrigerant becoming contaminated.

In order to simplify any maintenance work which may need to be done by different engineers (refrigeration engineers, mechanics, heating engineers, electricians), the enclosure 13 consists of three different modules, linked one to the next by means of flanges 19 and 20 assembled by known means (bolts, "bevel plates" etc). These three modules comprise an evaporation-flash module 21 containing an evaporation zone 22, a compression module 23 containing the two compression stages 1 and 2, and a condensation module 24 containing a de-superheating zone 25 optionally with an economizer, and the condensation zone 26.

The evaporation zone 22 is set up in the form of a flash evaporator, in which the internal energy of the fluid remains constant (isenthalpic expansion), the decrease in that of the liquid being exactly compensated by the increase in that of the vaporized liquid. To this end, the chilled water returning to the installation via a passage 27, which has been heated, to approximately 12° C. for example, passing through load circuit U incorporated in the installation for cooling purposes, is injected into the zone 22 in the form of droplets by means of a spray ramp 28 and evaporates instantaneously due to the very low absolute pressure, which may be in the order of 10 mbars, prevailing in this zone 22. In other words, the energy needed to vaporize the liquid comes from the liquid itself, due to an adiabatic process. The water, cooled as a result to a temperature which may be in the order of 7° C., is recovered at the bottom part of the enclosure and evacuated from it via a chilled water line shown by reference 29. The thermal exchanges in the refrigerant cycle are direct (exchanges by contact and not through surfaces) and there is very little irreversibility; the "nip" which occurs in plants with tube or plate exchangers is eliminated, which in practice enables a performance coefficient in excess of 7 to be obtained at evaporation and condensation temperatures of 7 and 30° C. respectively. The absence of heat exchange surfaces for the evaporator and the condenser also has an advantage in that there is no need to make provisions for longitudinal dismantling of the tubing or surface cleaning, thereby reducing the amount of space needed for the system.

The presence of water droplets in the vapor thus created is beneficial because it promotes de-superheating of the vapor during the next compression phase, thereby creating a lower flow by volume, which means that the passage sections can be reduced and hence the size and cost of the installation. Moreover, the mass by volume is higher, enabling a higher compression rate to be produced, which helps to increase the overall performance factor.

Figure 4:
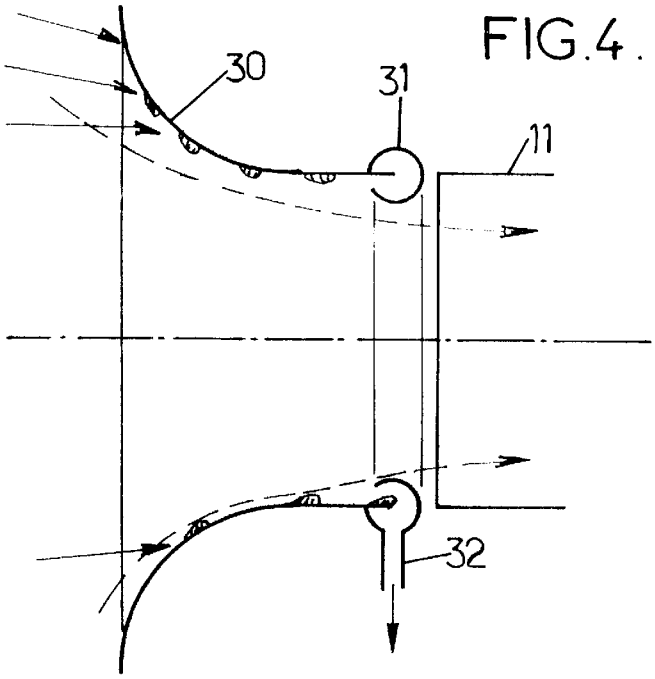
FIG. 4 is a view in partial axial section showing the liquid/vapor separation in a suction convergent at the intake of each compression stage and an inertial separation trough.

However, in order to prevent any erosion of the blading of the compressor wheels by the droplets of water travelling at high speed, the liquid/vapor separator or degassing system 14, 15 positioned at the suction inlet 3, 4 of each compression stage, is followed or replaced by a special fixed convergent cowl 30, as illustrated in FIG. 4, on the wall of which the water can flow, the trailing edge terminating in a circular water catchment or trough 31, provided with a bottom water discharge outlet 32 which provides effective inertial separation between the water and the vapor. It should be pointed out that a quite significant quantity of water flows on this wall 30 of the convergent, due to the separation which results from imparting axial speed to the vapor, in conjunction with the coalescence of water droplets, which highlights the interest of this layout. No attempt is made to eliminate the mist in the outlet section of the convergent, however, because its presence is conducive to the de-superheating process and its mechanical effects are reduced.

Figure 5:
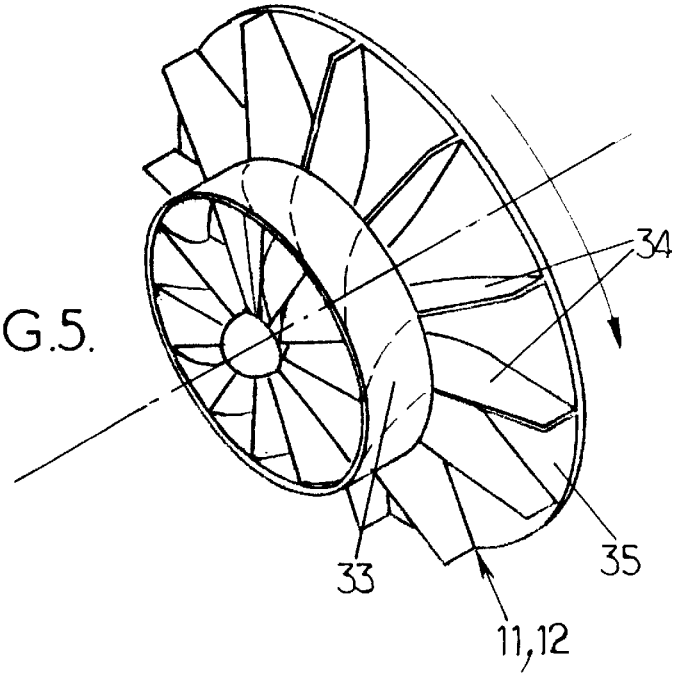
FIG. 5 is a perspective view of a semi-open and hooped compression stage.

Furthermore, to prevent any erosion in what is referred to as the "crescent" blading of the compression wheel 11, 12 due to the impact of fine droplets which remain suspended in the vapor, the blading is advantageously encircled in the axial portion thereof by a hoop, shown by reference 33 in the perspective view of FIG. 5. This hoop, which also has anti-vibration effect, is therefore able to channel the water sucked in until it leaves the axial zone.

Figure 6:
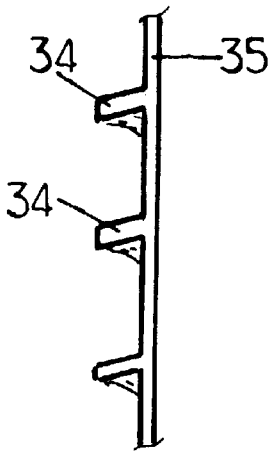
FIGS. 6 and 7 are views in partial developed section of two possible variants of a rotor blading for the compressor.
Figure 7:
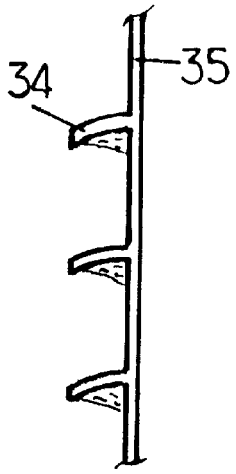

The partially developed view shown in section in FIG. 6 also illustrates the option of using blades 34 having an acute angle relative to the plane of the rear flange 35 for the rotor blading, which helps to drive the water in the direction of rotation. It would also be possible to make these vanes 34 slightly concave, producing the same effect (FIG. 7).

Figure 8:
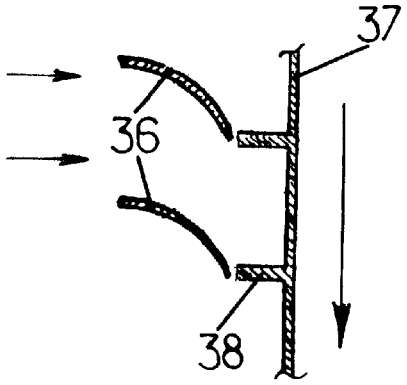
FIG. 8 is a view in developed partial section of a simplified compressor rotor comprising a rotating flange provided with radial flat blades and co-operating with static blading to pre-rotate the fluid.

FIG. 8 illustrates a simplified embodiment of another compressor which may be used if it is desirable to reduce cost price or reduce the rotating masses for the booster 8 or for the compression wheels, this variant also obviating the need for the hoop 33 mentioned above: the compressor comprises a rotor with a rotating flange 37 provided with flat radial blades 38, optionally co-operating with static blading 36 to pre-rotate the fluid.

The compressed vapor in the first stage 1 of the compressor is directed towards the second stage 2 by the flow passages 5 mentioned above and also shown in FIG. 3. These passages may have a radial diffuser at the outlet of the stage, which may be plain or provided with blades 39, **39*a* and/or axial 40, 40*a* with blades (as is the case in the top part of the drawing), designed to increase the vapor pressure by decreasing its speed. It may be necessary to provide an additional water injection into the diffuser, downstream of the wheel in order to de-superheat the vapor. If a radial and/or axial diffuser is used, it may be of advantage to make provision for this injection close to the change in direction, in the elbow between the diffusers 39 and 40 and/or in the trailing edge of the blades 39, 39*a*** at the top part of the drawing.

Before being sucked into the inlet to the second compression stage 2, the vapor leaving the passages 5 is de-superheated in the intermediate de-superheating zone 25 mentioned above, which in this example is located in the vicinity of the end 17 of the confinement enclosure 13, in order to avoid excessive temperatures being reached at the compressor outlet. This de-superheating may be effected by means of "expansion-flash" in the water flow from the condenser and returned to the evaporator, constituting an economizer to provide partial cooling of this water. In effect, since the water has a very high latent heat, evaporating a small volume of liquid is sufficient to de-superheat the vapor.

The vapor from the second compression stage 2 at a temperature close to condensation at the corresponding pressure then passes through the condensation zone 26 via other static passages 41. Condensation is effected by mixing, the heat exchange being produced between the vapor phase from the compressor and the liquid droplets dispersed by the spray ramp 42 supplied via a return line 43 for the cooled water (approximately 25° C.) of the fluid cooler (A), this being a conventional fluid cooler with a coil and mechanical ventilation, preventing any contact between the water and the outside air so as to avoid any biological or chemical contamination as well as the presence of gas dissolved in the water. The water heated by condensing the vapor is collected at the bottom of the enclosure and returned to the fluid cooler via a line 44 (FIG. 3).

Figure 9:
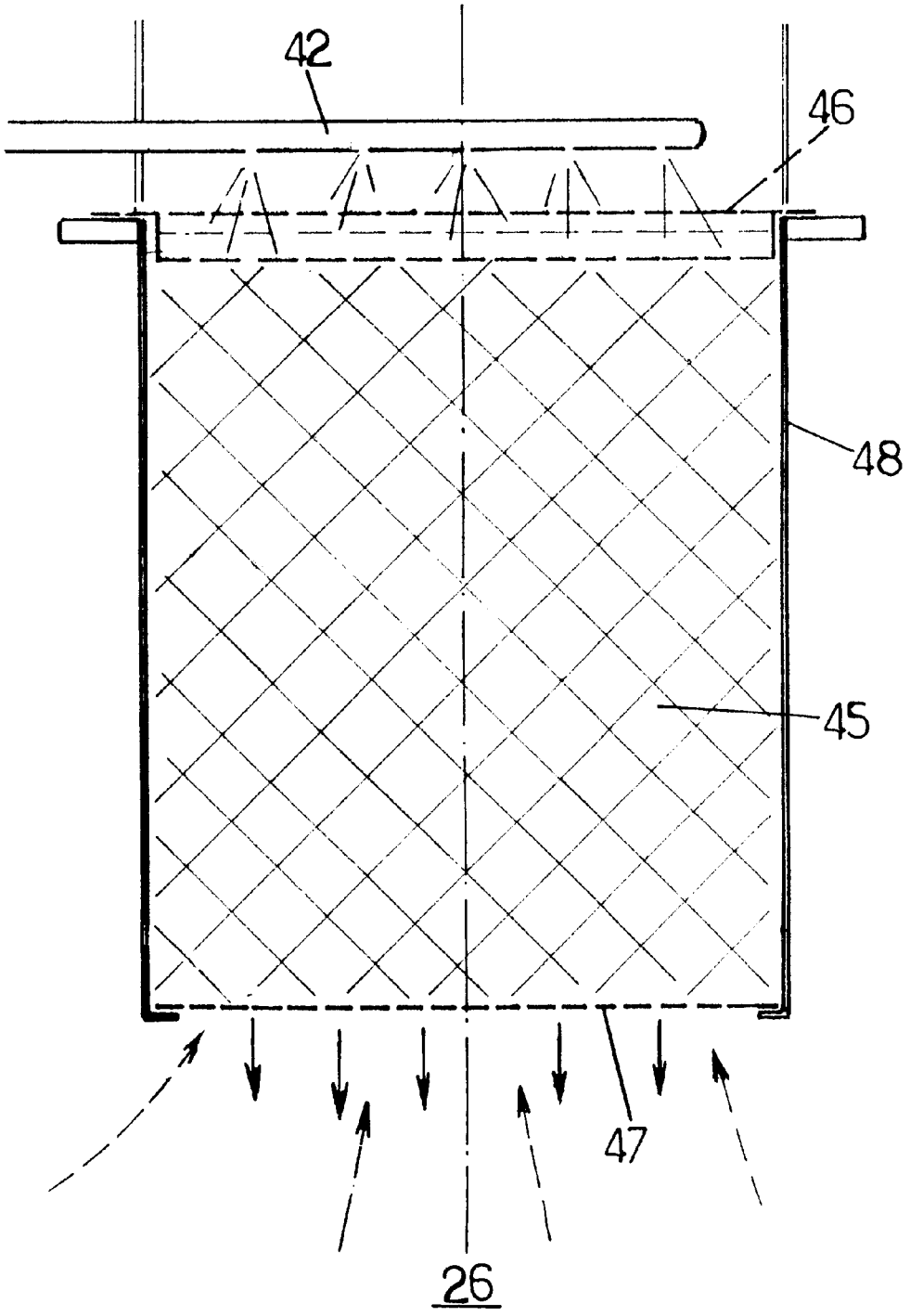
FIG. 9 is a schematic illustration of a packed condensation zone.

It should be pointed out that the main resistance to the occurrence of condensation is not associated with convection in the vapor but rather conduction in the liquid, which is why it may optionally be appropriate to provide for as long as possible a residence time of the liquid in the condenser, by increasing the contact surfaces and providing agitation with the vapor circulating in counter-flow, created by packing the condenser, for example with Raschig rings. A packing of this type is schematically illustrated in by reference 45 in FIG. 9 and is surmounted by a flow distributor 46 supplied with water cooled by the ramp 42, a grating 47 being provided at the base of the packing to hold it in place inside a rack 48.

Reference 49 in FIG. 3 denotes a vacuum pump, the vacuum being applied at the condensation pressure. When the installation is started up, at which point the enclosure 13 is filled with compressed air, the pump will have to evacuate this air to bring the internal absolute pressure to a value close to 40 mbars. In order to reduce the time needed for this evacuation, a start-up group may be provided, for example of the ejector type, with water as the driving fluid since the coolant water of the condenser can be used.

Figure 10:
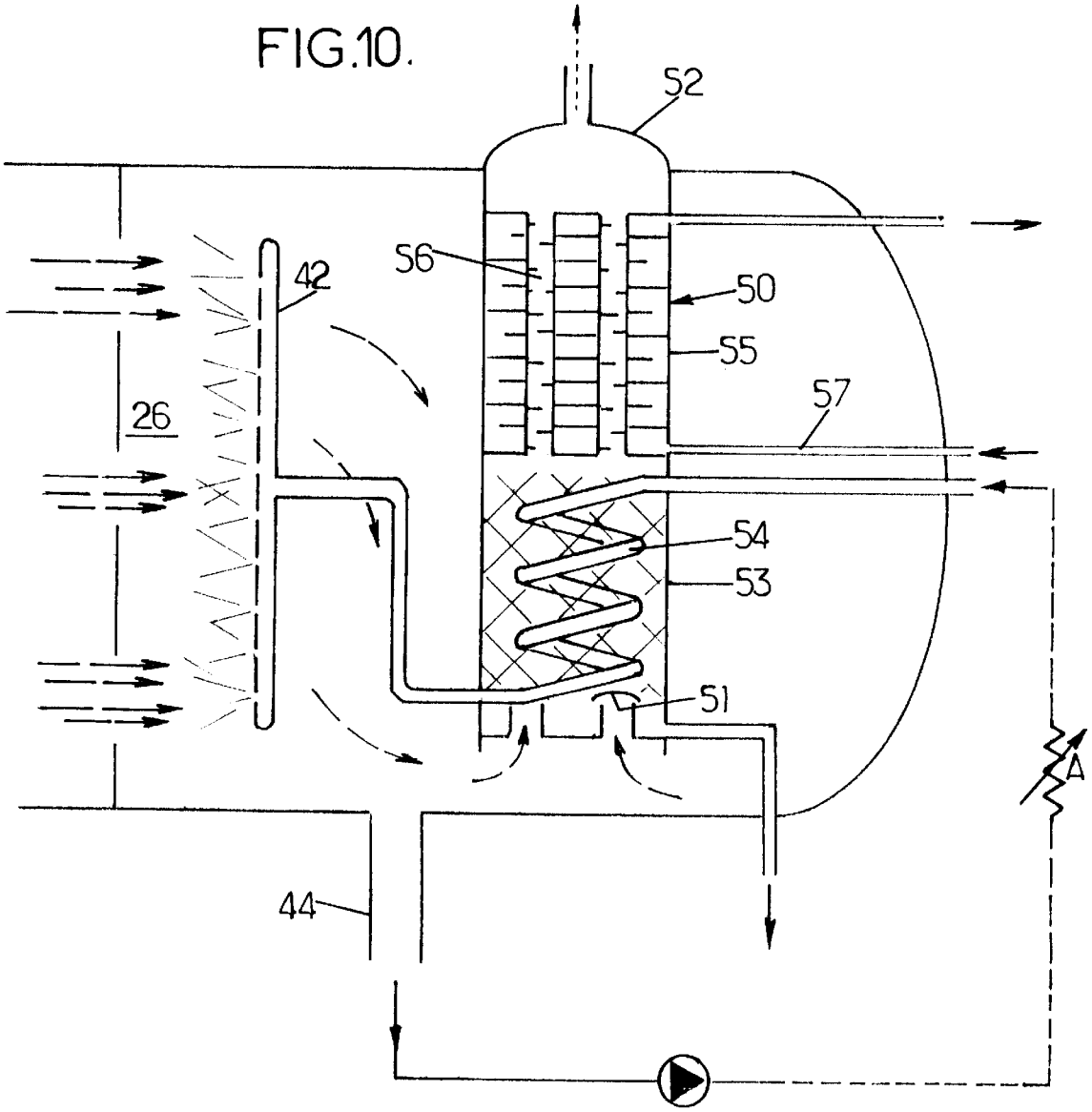
FIG. 10 illustrates a "reflux" condenser disposed at the outlet of the condensation zone.

In order to reduce the vapor flow extracted with the non-condensable substances, mainly air, it will be of advantage to provide a "reflux" condenser at the outlet of the condensation zone 26. A "reflux" condenser of this type, illustrated in FIG. 10, could consist of a column 50 at the base of which the residual vapor from the condensation zone 26 is injected through baffle plates 51, the wet saturated non-condensable substances being evacuated via its top end 52 towards the vacuum pump 49. This column may comprise, in succession, two zones in counter-flow: firstly a zone 53 in which some of the vapor is condensed by means of a coil surface exchanger 54 supplied with refrigerant from the return water of the fluid cooler before being sprayed in the ramp 42 of the condenser, and secondly a zone 55 in which another part of the vapor is condensed by means of a surface tube exchanger 56 and baffle plates for the circulating water, the refrigerant in this case being supplied by a small flow of chilled water 57 from the evaporation zone 22. It should be pointed out that the "reflux' condenser may be provided without one or other of the two parts described above or alternatively the two types of surface exchange systems reversed.

In order to operate the installation at partial load, the supply frequency of the synchronous motor 6 may be varied or a heat recycling circuit could be provided for a certain liquid flow rate from the condensation zone 26 to the evaporation zone 22.

Figure 11:
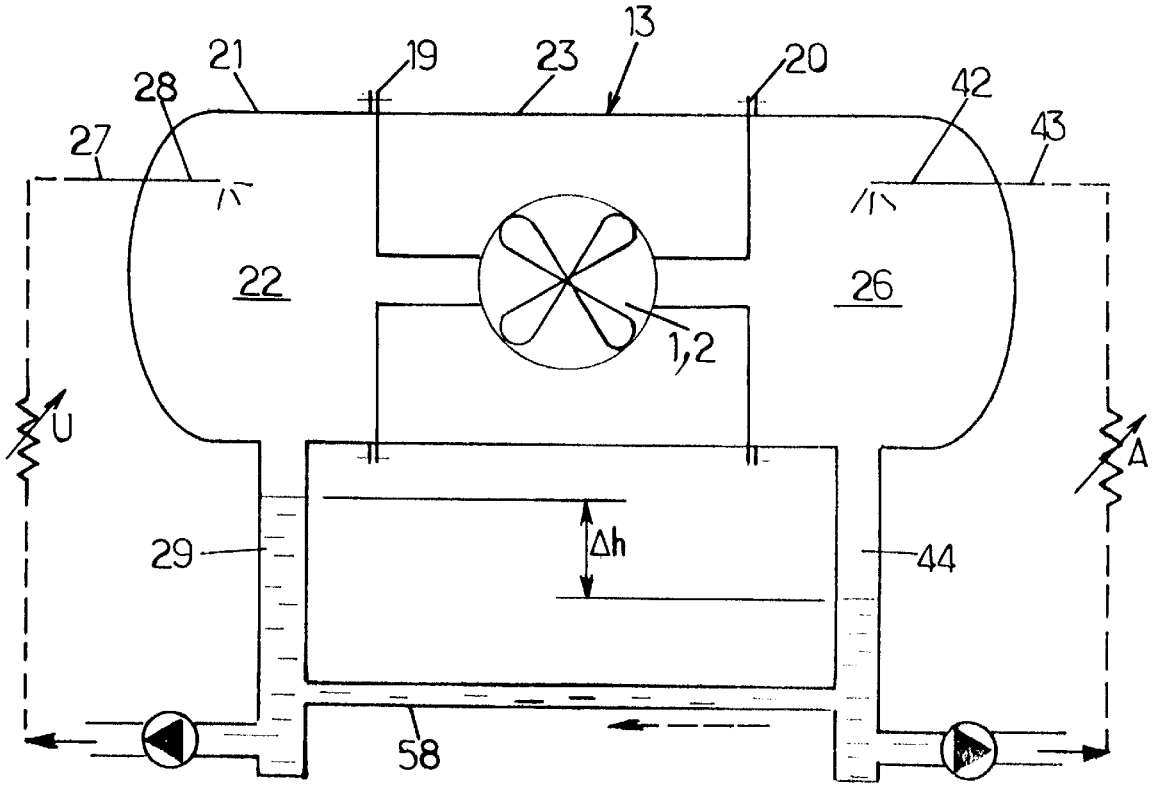
FIG. 11 is a schematic view of the installation overall.

The diagrammatic illustration given in FIG. 11, in which the same references as those of FIG. 3 have been used, shows how the difference in pressure between the two zones 22 and 26 can be very simply compensated by a line 58 linking the bases of water columns of different heights provided at the discharge 29 and 44 of these two zones. It should be note that the intermediate de-superheating between the compression stages may incorporate an "expansion-flash" with a low flow rate of water from the condenser 26 and returned via the line 58 to the evaporation zone 22, constituting an economizer to partially cool this water.

It would also be conceivable to produce excess cold overnight and store it in the form of chilled water or ice, this cold then being recovered during the day.

Figure 12B:
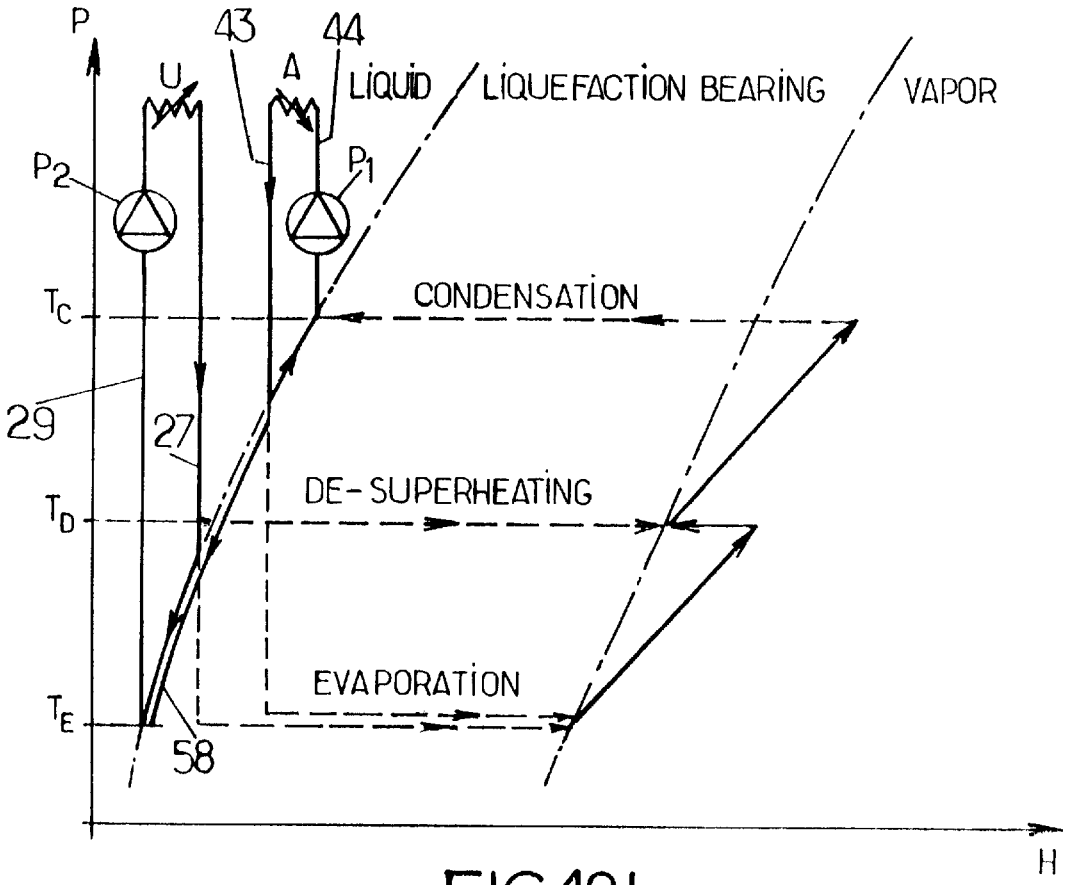
FIG. 12*b* is an example of an enthalpy diagram P=f(H) for an installation as proposed by the invention.
Figure 12A:
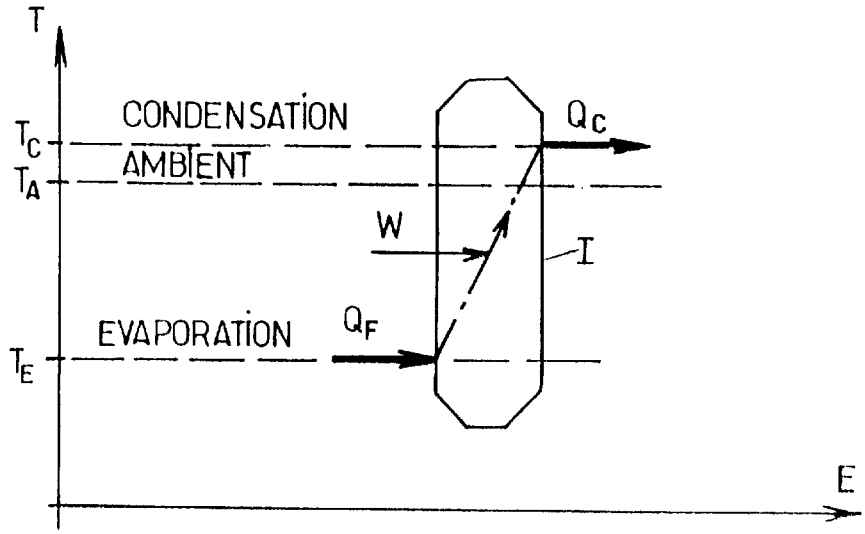
FIG. 12*a* is a thermodynamic diagram of the installation.

In a diagram T=f(E), E representing the energy exchanged, FIG. 12*a* shows the thermodynamic layout of the installation I. $Q_F$ represents the heat taken from the cold source, namely the load circuit U; W represents the work input to the installation I and $Q_C$ the heat output to the heat source, namely the fluid cooler A (see also FIG. 12*b*), the equation linking these values being $|Q_F|=|Q_C|+|W|$.

The enthalpy diagram of FIG. 12*b* illustrates conventional operation of the installation I. The water is evaporated at a temperature $T_E$ of about 7° C. in the evaporation zone 22, then compressed in the first compression stage 1, de-superheated to a temperature TD of about 18° C., compressed in the second compression stage 2 to produce a temperature $T_C$ of about 30° C., and condensed in the condensation zone 26. The condensation water is pumped by a pump $P_1$ to the fluid cooler A at 44, and is restored to a temperature of about 25° C. at 43 (heat-exchanging cycle). In the cold-exchange cycle 27, 22, 29, the water is cooled by vaporization to between about 12 and 7° C., and is pumped through the load circuit U by a pump $P_2$.

Although this description is given with emphasis on the refrigeration aspect, the installation could also be operated with heat generation as its primary function, in which case the pressure inside the enclosure could be above atmospheric pressure so as to attain condensation temperatures in excess of 100° C.

Figure 14:
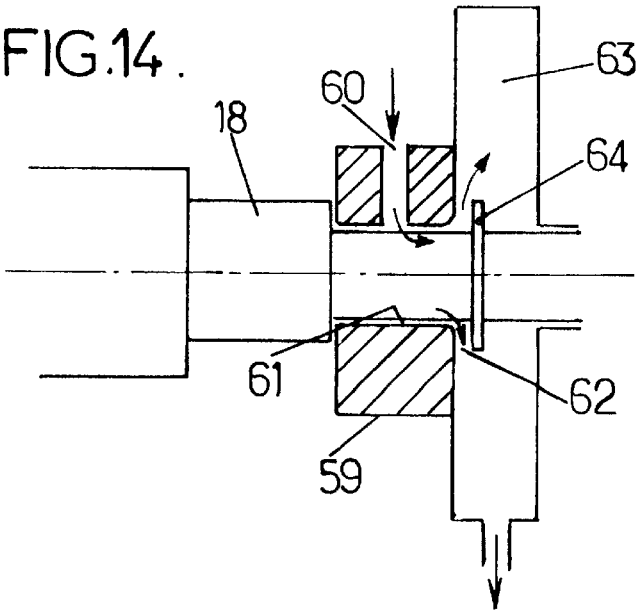
FIG. 14 shows a water bearing for the motor shaft.

Finally, FIG. 14 illustrates one possible structure for the water bearing for the shaft 18 of the electric motor 6. This bearing, shown by reference 59, comprises an intake for compressed liquid 60, which is partially expanded by dynamic effect in the space 61 between the bore of the bearing and the surface of the shaft 18, before being additionally expanded and partially vaporized as it leaves this space at 62. The vapor and residual liquid are then directed into a settling chamber 63 by means of a baffle plate 64.

What is claimed is:

1. Heat pumping installation, implementing cold-exchange and heat-exchange cycles, for refrigeration purposes, of the type incorporating a compression-expansion refrigerant cycle, comprising an evaporation zone prior to compression and a condensation zone after the latter, in which the thermodynamic fluid used in said cycle as well as the fluid used in the cold-exchange and heat-exchange cycles is water, the thermal exchanges occurring during vaporization and respectively condensation between these last two cycles and said refrigerant cycle being direct without the use of exchange surfaces, and the cold produced by this installation usually being at a temperature in excess of 0° C. or at a negative temperature, wherein the refrigerant cycle is operated on the basis of a dynamic compression in a compressor having wheels with two separate compression stages linked to one another by at least one thermal exchange zone and contained in a confinement enclosure for vapor which is hermetically sealed and thermally insulated, the wheels of these two stages being mounted directly on the opposite ends of the shaft of a common, sealed, variable speed electric motor disposed inside said enclosure between these stages.

2. Heat pumping installation as claimed in claim 1, wherein said variable speed electric motor is a synchronous motor having a rotor with permanent magnets co-operating with a frequency controller.

3. Heat pumping installation as claimed in claim 1, wherein the shaft bearings of said motor are of the type having ceramic roller bearings.

4. Heat pumping installation as claimed in claim 1, wherein the bearings of the shaft of said motor are of the fluid or plain type operating with water and having an anti-cavitation device, or with oil and having a sealing device, or alternatively of the magnetic type.

5. Heat pumping installation as claimed in claim 1, wherein the bearings of the shaft of said motor are disposed to the side of said motor, the compressor wheels being mounted in an overhanging arrangement on the ends of said shaft.

6. Heat pumping installation as claimed in claim 1, wherein the two compression stages are arranged opposing one another on either side of the common electric drive motor, with their respective inlets directed towards the ends of the confinement enclosure, said vaporization and de-superheating zones thus being disposed between these ends of the enclosure and respectively the inlet of the first and the inlet of the second compression stage.

7. Heat pumping installation as claimed in claim 1, wherein the two compression stages co-operate with a third compression stage disposed inside the confinement enclosure or communicating with it and constituted by a booster disposed upstream or downstream of the compressor or alternatively between these two stages.

8. Heat pumping installation as claimed in claim 7, wherein said booster is driven by a hydraulic turbine operated with water borrowed from the internal circuit, on a level with the evaporation or condensation.

9. Heat pumping installation as claimed in claim 7, wherein said booster is driven by a vapor expansion turbine.

10. Heat pumping installation as claimed in claim 7, wherein said booster is driven by an independent electric motor.

11. Heat pumping installation as claimed in claim 7, wherein said booster or the compression stages are constituted by one or more compression wheels comprising a rotor with a rotating flange provided with flat radial blades and optionally co-operating with static blading to pre-rotate the fluid.

12. Heat pumping installation as claimed in claim 7, wherein said condensation zone is located in the vicinity of the end of said confinement enclosure close to the inlet of the second compression stage.

13. Heat pumping installation as claimed in claim 1, wherein said condensation zone is located between the de-superheating zone and the inlet of the second compression stage.

14. Heat pumping installation as claimed in claim 1, consisting of three separate modules linked one to the next by demountable fixing means, namely an evaporation-flash module containing an evaporation zone, a compression module containing the compression stages and a condensation module containing a de-superheating zone and the condensation zone.

15. Heat pumping installation as claimed in claim 1, wherein the evaporation zone is set up in the form of an evaporator-flash, the chilled water returned to the installation being injected in the form of droplets into said zone by means of a spray ramp.

16. Heat pumping installation as claimed in claim 1, wherein a liquid/vapor separator or degassing system is positioned at the suction inlet of each compression stage.

17. Heat pumping installation as claimed claim 1, wherein a special convergent cowl is provided at the suction inlet of each compression stage, on the wall of which water can flow and whose trailing edge terminates in a circular water catchment producing inertial separation provided with a bottom water discharge outlet.

18. Heating pump installation as claimed in claim 1, wherein the blading of the compressor wheels is encircled in the axial portion thereof by a hoop designed to channel the sucked in water until it leaves the axial zone.

19. Heat pumping installation as claimed in claim 1, wherein the blades of the rotor blading subtend an acute angle with the plane of the rear flange of this rotor or are slightly concave, which is conducive to driving the water in the direction of rotation.

20. Heat pumping installation as claimed in claim 1, wherein the compressed vapor in a compression stage is directed towards the next section by means of circulation passages which may have a radial diffuser at the outlet of the compression stage, which may be plain or provided with blades and/or axial provided with blades optionally having an additional water injection downstream of this stage.

21. Heat pumping installation as claimed in claim 1, wherein the intermediate de-superheating between the compression stages co-operates with an "expansion-flash" of the water flow from the condenser and returned via piping to the evaporation zone, constituting an economizer to provide partial cooling of this water.

22. Heat pumping installation as claimed in claim 1, wherein a condensation is effected by mixing, the thermal exchange being produced between the vapor phase from the compressor and liquid droplets dispersed by a spray ramp supplied via a return line for cooled water of a fluid cooler.

23. Heat pumping installation as claimed in claim 22, wherein, in order to ensure as long as possible a residence time of the liquid in the condensation zone, this zone has a packing such as Raschig rings increasing the contact surfaces and creating agitation with the vapor circulating in counter-flow.

24. Heat pumping installation as claimed in claim 22 or 23, comprising a "reflux" condenser.

25. Heat pumping installation as claimed in claim 24, wherein said "reflux" condenser consists of a column comprising in succession firstly, a counter-flow zone in which some of the vapor is condensed by means of a surface exchanger in which the supply of refrigerant is taken from the return water of the fluid cooler before it is sprayed in the ramp of the condenser and, secondly, a counter-flow zone in which another part of the vapor is condensed by means of a surface exchanger, the supply of refrigerant in this case being provided by a small flow of chilled water from the evaporation zone.

26. Heat pumping installation as claimed in claim 1, wherein, in order to operate at partial load, it comprises a heat recycling circuit for a certain flow of liquid from the condensation zone to the evaporation zone.

27. Heat pumping installation as claimed in claim 1, being regulated. so as to produce an excess of cold during the night and store it in the form of chilled water or ice, this cold then being recovered during the day.

28. Heat pumping installation as claimed in claim 1, wherein the shaft of the electric motor is borne by water bearings having an inlet for compressed liquid, which can then be subjected to a partial expansion by dynamic effect in a space between a bore of the bearing and the surface of the shaft, before being subjected to additional expansion and partial evaporation at its outlet from this space, the vapor and the residual liquid then being directed into a settling chamber by means of a baffle plate.

* * * * *